US009127393B2

(12) United States Patent
Gomez Caudevilla et al.

(10) Patent No.: US 9,127,393 B2
(45) Date of Patent: Sep. 8, 2015

(54) WASHING MACHINE

(75) Inventors: Miguel Angel Gomez Caudevilla, Zaragoza (ES); Ismael Gracia Bobed, Zaragoza (ES); Roberto Latre Abadia, Zaragoza (ES); Gerardo Martinez Perez, Zaragoza (ES); Juan Melantuche Fuente, Cuarte de Huerva (ES); Jose Luis Perez Luengo, Zaragoza (ES); Eduardo Recio Ferrer, Zaragoza (ES)

(73) Assignee: BSH HAUSGERÄTE GMBH, Munich (DE)

( * ) Notice: Subject to any disclaimer, the term of this patent is extended or adjusted under 35 U.S.C. 154(b) by 1080 days.

(21) Appl. No.: 13/131,286

(22) PCT Filed: Dec. 11, 2009

(86) PCT No.: PCT/EP2009/066976
§ 371 (c)(1),
(2), (4) Date: May 26, 2011

(87) PCT Pub. No.: WO2010/066893
PCT Pub. Date: Jun. 17, 2010

(65) Prior Publication Data

US 2011/0232698 A1 Sep. 29, 2011

(30) Foreign Application Priority Data

Dec. 12, 2008 (ES) ..... 200803571

(51) Int. Cl.
*B08B 3/12* (2006.01)
*D06F 39/08* (2006.01)

(52) U.S. Cl.
CPC ..... *D06F 39/086* (2013.01)

(58) Field of Classification Search
CPC ..... D06F 39/086
USPC ..... 68/3 R, 208
See application file for complete search history.

(56) References Cited

U.S. PATENT DOCUMENTS 2,512,394 A * 6/1950 Sullivan ..... 68/18 F
2,662,536 A * 12/1953 Martiniak et al. ..... 134/56 D
(Continued)

FOREIGN PATENT DOCUMENTS

DE 3624065 A1 2/1988
DE 4442089 A1 5/1996
(Continued)

OTHER PUBLICATIONS

International Search Report PCT/EP2009/066976.
(Continued)

*Primary Examiner* — Michael Barr
*Assistant Examiner* — Benjamin L Osterhout
(74) *Attorney, Agent, or Firm* — Nixon & Vanderhye, P.C.

(57) ABSTRACT

A washing machine having a simple, leak-tight drain line that can be easily assembled on the wash tub of the washing machine is disclosed. The washing machine includes a valve part that is connected to the wash tub in a sealed fashion and designed in one piece together with the wash tub. The valve part has a drain valve, an outlet connection having a drain opening, and a pipe part connected to the outlet connection and to a drain pump for water transfer. The drain valve can float in the wash water and is moveably disposed inside the valve part to seal the drain opening when wash water is located inside the wash tub and when the drain pump is idle, and to open the drain opening when no wash water is located inside the wash tub and when the drain pump is operating.

20 Claims, 3 Drawing Sheets

(56) References Cited

U.S. PATENT DOCUMENTS

| | | | | |
|---|---|---|---|---|
| 2,986,917 | A * | 6/1961 | Smith | 68/20 |
| 3,172,277 | A * | 3/1965 | Burkland | 68/12.16 |
| 3,172,278 | A * | 3/1965 | Burkland | 68/12.14 |
| 3,307,825 | A * | 3/1967 | Sollenbarger | 251/129.2 |
| 4,821,537 | A | 4/1989 | Zinkann et al. | |
| 2011/0023557 | A1 | 2/2011 | Borque Marquina et al. | |

FOREIGN PATENT DOCUMENTS

| | | | |
|---|---|---|---|
| ES | 2216660 | A1 | 10/2004 |
| WO | 2006129159 | A1 | 12/2006 |

OTHER PUBLICATIONS

National Search Report ES P200803571.

* cited by examiner

WASHING MACHINE

This application is a U.S. National Phase of International Patent Application No. PCT/EP2009/066976, filed Dec. 11, 2009, which designates the U.S. and claims priority to Spanish Patent Application No. ES P200803571, filed Dec. 12, 2008, the entire contents of each of which are hereby incorporated by reference.

BACKGROUND OF THE INVENTION

The present invention relates to the field of washing machines, comprising a wash tub that is filled with wash water and that has a drain opening, a drain pump, a drain line that connects the water in the wash tub to the drain pump and a valve part that is connected to the wash tub in a sealed fashion, and comprising a pipe part that is connected to the drain pump for water transfer, with the washing machine also having a drain valve that can float in the wash water, said valve being disposed moveably inside the valve part in order to seal the drain opening when wash water is located inside the wash tub and when the drain pump is idle, or in order to open the drain opening when no wash water is located inside the wash tub or when the drain pump is operating.

PRIOR ART

Patent DE 4442089 A1 describes a washing machine comprising a wash tub, in which a drum is arranged, which can rotate therein and in which the items of clothing to be washed are placed.

The wash tub comprises a wash water inlet connection in its upper part, in order to partially fill the wash tub in order to wash and rinse the materials to be washed. A drain opening is arranged in the lower part of the tank, to which a drain line is connected on the outer part of the wash tub, said drain line connecting the wash tub to the drain pump in order to empty the wash water from the wash tub if the washing process so requires.

To complete the washing process, the drain pump pushes all the water out of the inside of the tub and the drain line, as a result of which, at the start of the following cycle, the water flowing into the wash tub fills the drain line and does not take part in the washing process. To prevent the detergent introduced into the tub for the washing process from reaching the drain line, this has a valve part, in which a floatable valve is disposed in the shape of a hollow ball, which fits into the drain opening if sufficient water flows in for the start of the cycle. In this way, the detergent does not escape through the drain line, as a result of which damages caused to the environment are prevented. The valve part of the drain line is a flexible part with a relatively complex shape, which has to be fastened in a sealed fashion in the manner of a flange to the wash tub by means of any given system.

Patent DE 3624065 A1 describes a washing machine similar to that described above, which comprises a drain line similar to that of the preceding machine with a valve part, which is connected to the wash tub in a sealed fashion by means of a flange. The valve is disposed inside the valve part and is embodied as a flap or tongue, which is connected in one piece to the wall of the drain line, more precisely to the wall of the valve part. The valve part and the valve are manufactured from a complex part made of flexible material. When no water is located inside the drain line or the pump is operating, the valve drops and allows for the connection between the inside of the tub and the drain line. Similarly to the process of the preceding machine, when the washing cycle begins, the drain line fills with water and the water itself causes the valve to float and presses against the drain opening of the wash tub.

Both configurations of a washing machine comprise a complex drain line, as a result of which leak tightness problems may be produced.

BRIEF SUMMARY OF THE INVENTION

It is the object of the invention to create a washing machine using a simple, leak-tight drain line that can be easily assembled on the wash tub of the washing machine.

This object is achieved using a washing machine comprising a wash tub that is filled with wash water, and that has a drain opening, a drain pump, a drain line that connects the water in the wash tub to the drain pump and a valve part that is connected to the wash tub in a sealed fashion, and comprising a pipe part that is connected to the drain pump for water transfer, also a drain valve that can float in the wash water, said valve being disposed moveably inside the valve part in order to seal the drain opening when wash water is located inside the wash tub and when the drain pump is idle, or in order to open the drain opening when no wash water is located inside the wash tub or when the drain pump is operating, with the valve part being designed in one piece together with the wash tub and the pipe part being connected to an outlet connection of the valve part.

In this way the wash tub, in addition to the drain opening, contains the valve part made of one piece, as a result of which the leak tightness is always better since connections between the two parts are prevented. The drain line is simplified since, upon introduction in one piece into the wash tub, only the pipe part has to be connected to the outlet connection of the valve part. In particular, the pipe part may be a cylindrical standard pipe, which is inserted into the outlet connection and into the drain pump by means of conventional flanges.

The washing machine can be a front loader or a top loader. It may comprise a drum inside the wash tub, said drum having a horizontal rotation or being a drum with a vertical rotation.

The valve part is designed as an integral part of the tub and comprises an interior space, which is connected to the inside of the wash tub by way of the drain opening. Integral part means that it is not a part which can be disassembled and reassembled. The drain opening can be sealed by means of the valve which can float in the wash water. The interior space of the valve part comprises an outlet connection, to which the pipe part is connected. The floatable valve, can be designed as an element with a lower density than the wash water, with such a shape that it fits into the drain opening. It is particularly advantageous that the drain opening is circular, since the valve may comprise a spherical or partially spherical shape, which is fitted therein and blocks the throughflow of the wash water. It is necessary for the inside of the valve part to have such a shape which allows the movement of the valve in its interior in a non-deliberate manner and therewith remains sealed. The functionality of the valve during the washing process is the same as that according to the prior art, in which it keeps the drain opening closed while water is present in the valve part in order to press the valve against the opening.

In a preferred embodiment, the tub is designed from two tub sections made of plastic. Each of the tub sections comprises a part of the valve part, which was injection molded in one piece with the corresponding section. They are preferably connected by means of plastic welding technology, but not necessarily, since they can be glued or interlocked. The drain opening is designed in a first tub section and thus, when embodied as an injection molded part, prevents its edge having burs, which could hinder a correct closure of the valve.

In a special embodiment of the valve, provision is made for it to comprise the form of a flap. With such a geometry, less room is required inside the valve part. The drain valve in the form of a flap comprises a plug part which fits into the drain opening, a floating part and a hinge element, which is connected to the valve part in order to allow for the rotation of the drain valve between the opened and the closed position. With this configuration, the movement of the valve inside the valve part is restricted and the closure system is better controlled.

And in order to restrict it further, the drain valve comprises a stop, which restricts and prevents the rotation of the drain opening in the open position which keeps it stuck to the wall of the valve part.

To prevent the floating part from being flooded, as a result of which the floating of the drain valve and thus its function was made impossible, the stop restricts the rotation of the drain valve in the opened position to an opening between 15° and 35°, preferably between 20° and 30°, advantageously 25°.

The hinge element is designed as a rib, which is inserted into a recess of the first tub section. This is an assembly which is simple to design, which also ensures the correct position by means of a slider, which fits into the recess and restricts its displacement in the recess. And in order to prevent it moving into the recess, the second tub section presses against the hinge element in the recess of the first section of the tub when the two sections are connected.

To make better contact with the drain opening, the drain valve is designed from an elastic material. In this way, this is above all advantageous in the case of the drain valve type in flap form, which has a hinge part, in order to assist with the bending of this part, since it is preferably embodied from one piece and has to bend in the region of the hinge under the dead weight of the plug part and the floating part. In the event that it is a valve in the shape of a hollow ball, it is not necessary that it is flexible, however that it has a smooth surface in order to adjust to the drain opening. It is also advantageous for the drain valve to have an anti-stick surface at least in the plug part, in order to reduce the possibility of detergent residues, fibers or other elements sticking, which could negatively affect the closure.

It is advantageous for the drain opening to have a circular shape and the plug part to partially have a spherical shape, which fits into the drain opening. The shape of the plug part is not necessarily partially spherical, since a spherical shape can also perform the same function.

Provision is made for the floating part to have a cylindrical hollow shape with one end which is connected to the plug part, and that its other end is open where the air can enter if the water level increases in the valve part and assists with the floating of the valve. It can also be hermetically sealed so that air inside makes the valve float.

BRIEF DESCRIPTION OF THE DRAWINGS

Other advantages result from the following description of the drawing. An exemplary embodiment of the invention is shown in the figures. The drawing, the description and the claims contain a combination of numerous characteristics. The person skilled in the art will advantageously also consider the characteristics individually and connect the same in other meaningful combinations, in which

DETAILED DESCRIPTION OF EXEMPLARY EMBODIMENTS OF THE PRESENT INVENTION

Figure 1:
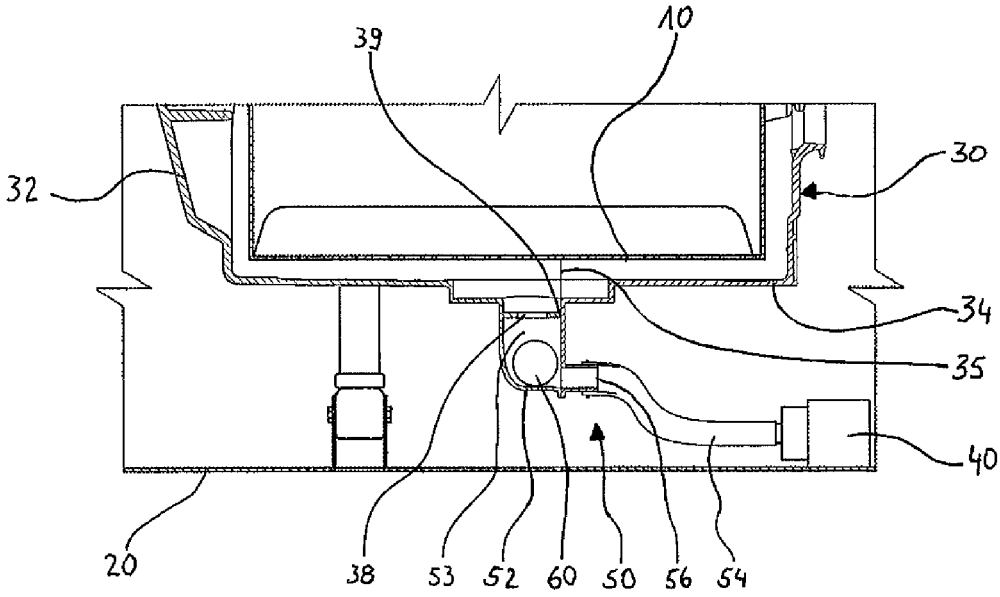
FIG. 1 shows a schematic side view of the lower part of a washing machine having a wash tub and a drain line according to the invention.

FIG. 1 shows a schematic sectional view of the lower region of a washing machine comprising a wash tub 30, in which a drum 10 is arranged, which can rotate therein and in which the items of clothing to be washed are placed. The wash tub is designed from two tub sections 32 and 34, which are connected by means of a connection region 35, which extends linearly through the connecting plane of the two sections. The wash tub is arranged in a washing machine frame 20, suspended on a system of springs and dampers.

The wash tub comprises a wash water inlet connection in its upper part, in order to partially fill the wash tub for washing and rinsing the materials to be washed. A drain opening 38 is embodied in the lower wall 33 of the first tub section 32. The lower wall of the first tub section 32, where the drain opening 38 is embodied, extends to the connecting plane of the two tub sections and hermetically connects on the sealing line 39 to a wall of the second tub section 34, if the two tub sections are connected. The drain line 50 is connected to the outer part of the wall of both wash tub sections 30, said drain line 50 connecting the wash tub 30 with the drain pump 40 in order to empty the wash water out of the wash tub, if the washing process so requires.

The drain line 50 is embodied from a valve part 52, which is designed in an overall plastic part with the tub sections 32 and 34, and a pipe part 54, which is connected to the valve part on the outlet connection 56 and to the drain pump 40. A valve 60 in the shape of a hollow ball, which is floatable and fits into the drain opening 38, is disposed inside the valve part 53 in order to seal it if sufficient water flows into the valve part.

Figure 2:
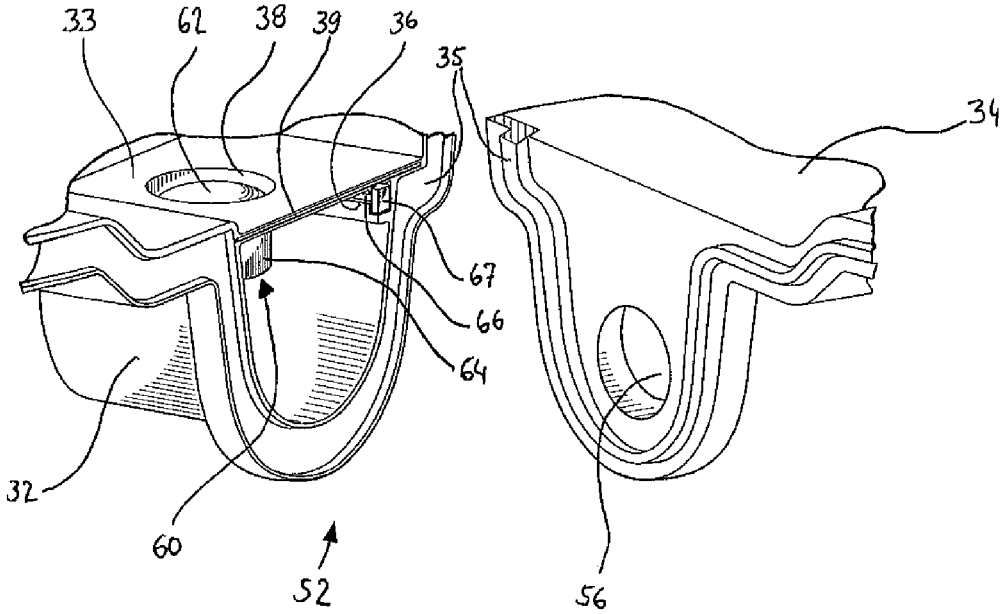
FIG. 2 shows a perspective view of the tub sections which face one another in the connection region of the valve part of the drain line.

FIG. 2 shows a perspective view of the valve part 52 of the wash tub 30 which opens toward the two tub sections 32 and 34. It shows the part of the first tub section 32, where the valve part 52 of the drain line is disposed. The drain opening 38 of the tub and the edge of the wall, which forms the connecting line 39 with the wall of the second tub section 34, is located in the lower wall of the first tub section, if both tub sections are connected. A groove 36, into which the hinge part 66 of the drain valve 60 is inserted, is disposed on one side of the valve part 52, until it is adapted by the slider 67. The drain valve is in the closed position B, and it is possible to view the plug part 62 of the drain valve through the drain opening 38. It is also possible to partially view the floating part 64 below the lower wall inside the valve part 53 of the drain line of the first tub section 32.

The second tub section 34 is located opposite to the first tub section 32, and the connection region 35 emerges as the circumference of both tub sections, which is preferably in one plane in order to facilitate closure of the tub. The method of closure for this plastic wash tub is a plastic injection molding method. The outlet connection 56 of the valve part of the drain line is embodied on the second tub section, although it may easily be embodied on the first tub section.

Figure 3:
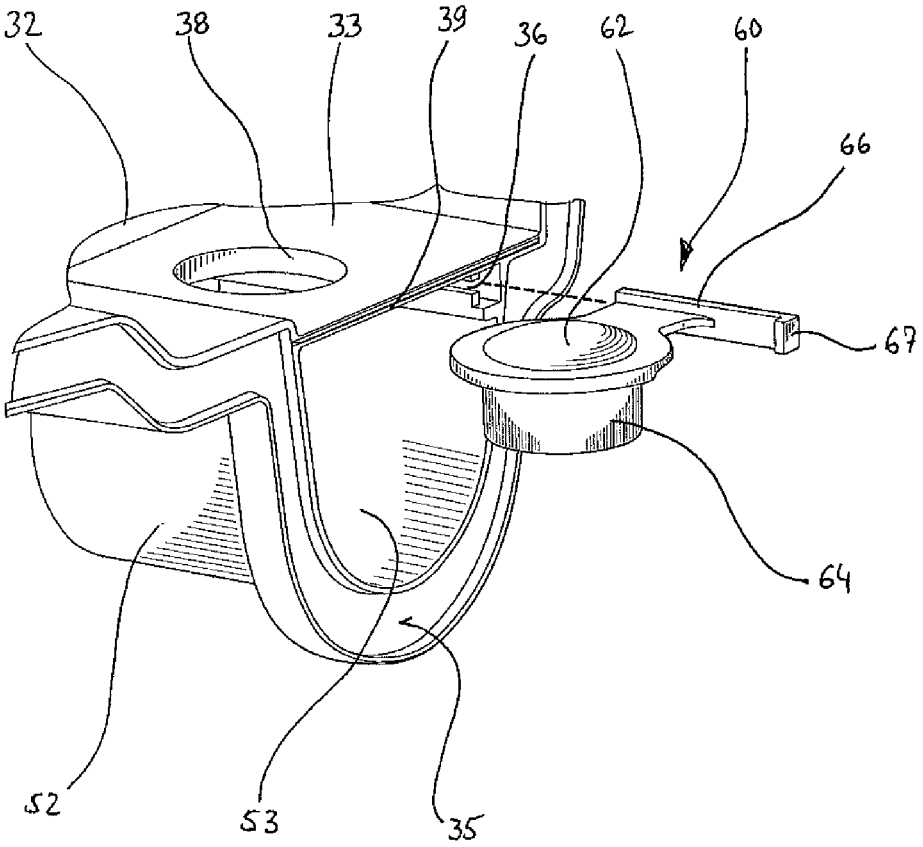
FIG. 3 shows a perspective view of the valve part of the drain line of the first tub section with the valve in the preassembled position.

FIG. 3 shows a perspective view of part of the first tub section 32, where the sub region which corresponds to this section of the valve part 52 of the drain line is located. The drain opening 38 of the tub and the edge of the wall, which forms the connecting line 39 with the wall of the second tub section, is located in the lower wall 33 of the first tub section 32, if both tub sections are connected. A groove 36, into which the hinge part 66 of the drain valve 60 is inserted in the direction of the dashed line, is located on one side of the valve part 52 until it fits inside the valve part 52 of the drain line. The hinge part 66 comprises the slider 67 at the end, said slider being outside of the groove 36. The drain valve 60 is in a preassembly position, where one can view the plug part 62 and the floating part 64.

Figure 4:
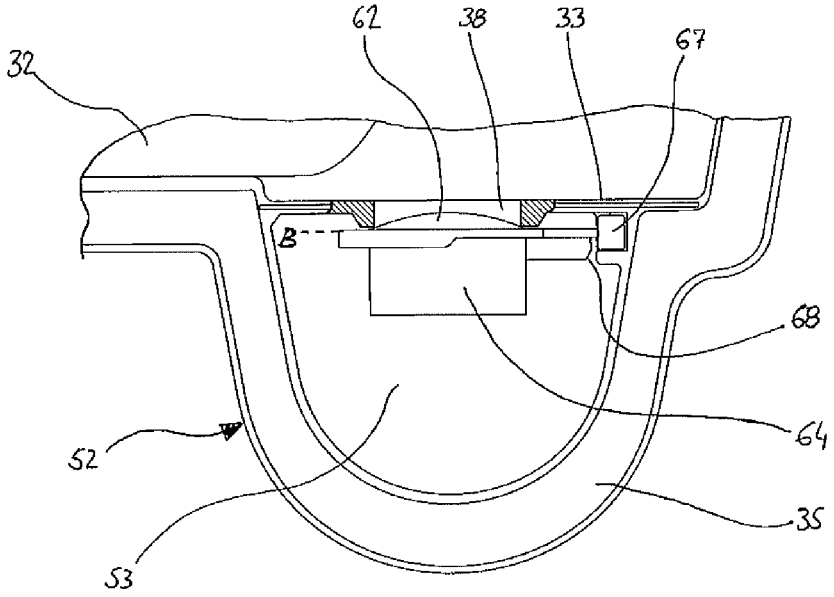
FIG. 4 shows a front view of the valve part of the first tub section with the assembled valve in the closed position and FIG. 5 shows a front view of the valve part of the first tub section with the assembled valve in the closed position.

FIG. 4 shows a front view of the first tub section 32 in the corresponding region of the valve part 52 of the drain line with the connection region 35 with the other tub section, running along its outer circumference. The lower wall 33 of the first tub section 32 and the connection region 35 restrict the inside of the valve part 52, where the valve 60 is disposed in the closed position B, connect to the wall of the valve part with the slider 67 at its outermost part. The lower wall 33 is shown in section in order to indicate the drain opening 38, where the plug part 62 of the valve sits and the floating part 64 is located below the plug part. The stop 68 is located in the region of the valve 60 next to the hinge part, without any contact with the wall of the valve part of the drain line.

Figure 5:
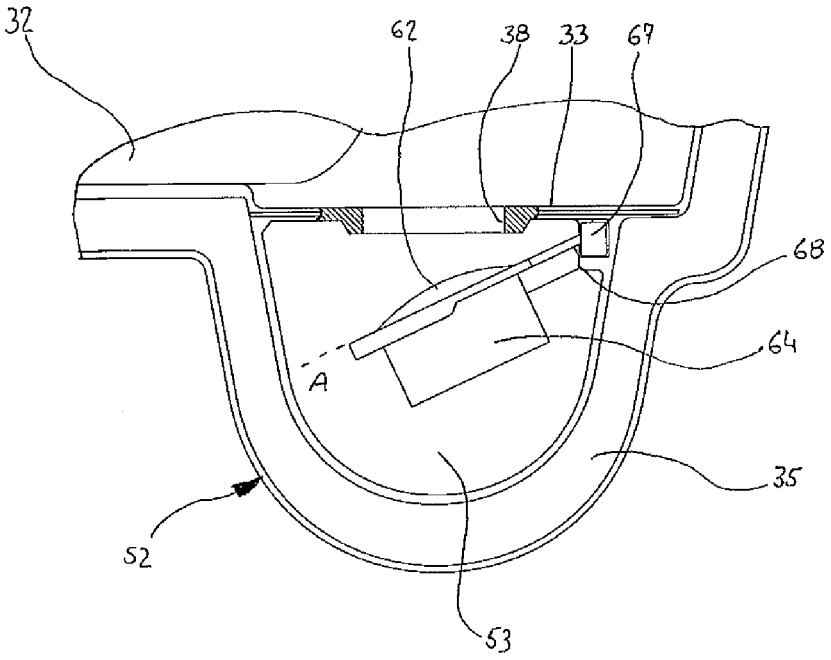

FIG. 5 shows a front view of the first tub section 32 in the corresponding region of the valve part 52 of the drain line with the connection region 35 with the other tub section, which runs along its outer circumference. The lower wall 33 of the first tub section 32 and the connection region 35 surround the inside of the valve part 52, where the valve 60 is located in an open position A, connect to the wall of the valve part with the slider 67 at its outermost part. The lower wall 33 is represented in section, in order to indicate the opened drain opening 38. In the region of the valve 60, which is closest to the hinge part, the stop 68 is disposed in contact with the wall of the valve part of the drain line and holds the valve 60 in its position with maximum opening. The plug part 62 of the valve is at a distance from the drain opening and the floating part 64 is located below the plug part.

LIST OF REFERENCE CHARACTERS

10 Drum
20 Frame
30 Wash tub
32 First tub section
33 Lower wall
34 Second tub section
35 Connection region
36 Recess
38 Drain opening
39 Sealing line
40 Drain pump
50 Drain line
52 Valve part
53 Inside of the valve part
54 Pipe part
56 Outlet connection
60 Drain valve
62 Plug part
64 Floating part
66 Hinge element
67 Slider
68 Stop A Opened position
B Closed position

The invention claimed is:

1. A domestic appliance for washing household items comprising:
- a wash tub configured to be filled with a predetermined volume of liquid;
- a drain system through which watering entering the wash tub may leave the wash tub; and
- a valve system configured to create a watertight seal between the wash tub and the drain system;
- wherein:
  - the wash tub comprises a first tub section and a second tub section, the first tub section and second tub section being formed by plastic injection molding; and
  - the drain system comprises:
    - a valve housing constructed as an integral part of the wash tub, the valve housing being configured to be one piece together with the wash tub, and the valve housing comprising an interior valve space;
    - a drain valve comprising a floating part and a plug part, wherein:
      - the floating part and the plug part of the drain valve are one continuous structure;
      - the floating part comprising a buoyant material; and
      - the plug part comprising a drain shape configured to engage and tightly fit a drain hole, the drain hole providing communication between the wash tub and the interior valve space.

2. The domestic appliance according to claim 1, wherein the drain valve is configured to be movably attached to a wall of the interior valve space.

3. The domestic appliance according to claim 2, wherein the drain valve is coupled to the wall of the interior valve space by a hinge.

4. The domestic appliance according to claim 2, wherein the wall of the interior valve space is configured to allow the drain valve to deflect no more than 25° from a position in which the drain valve seals the drain hole.

5. The domestic appliance according to claim 1, wherein the plug part of the drain valve further comprises a flap portion and a plug portion.

6. The domestic appliance according to claim 5, wherein the flap portion of the plug part is configured to form a seal with a surface surrounding the drain hole at the time the plug portion is engaged with the drain hole.

7. The washing machine of claim 1, wherein the valve housing is formed by at least said first and second tub sections.

8. The washing machine of claim 7, wherein the drain hole is formed in said first tub section.

9. The washing machine of claim 1, wherein the drain valve is a flap.

10. The washing machine of claim 9, further comprising a hinge element of the drain valve, said hinge element being connected to said valve housing so as to enable rotation of the drain valve between an open position and a closed position.

11. The washing machine of claim 9, further comprising a stop on the drain valve, said stop restricting the rotation of the drain valve in the open position.

12. The washing machine of claim 11, wherein the stop limits the angular rotation of the drain valve in the open position to a range of 15° and 35°.

13. The washing machine of claim 11, wherein the stop limits the angular rotation of the drain valve in the open position to a range of 20° to 30°.

14. The washing machine of claim 11, wherein the stop limits the angular rotation of the drain valve in the open position to approximately 25°.

15. The washing machine of claim 10, wherein the hinge element is a rib, said rib fitting into a recess in a tub section.

16. The washing machine of claim 15, wherein the hinge element includes a slider, said slider fitting into said recess in said tub section, said slider restricting movement of said hinge element in said recess.

17. The washing machine of claim 10, wherein said second tub section presses against said hinge element when said hinge element is fitted into said recess in said first tub section if said first and second tub sections are joined.

18. The washing machine of claim 1, wherein said drain valve is made from elastic material.

19. The washing machine of claim 10, wherein said drain hole is circular and said plug part has a spherical shape.

20. The washing machine of claim 1, wherein the floating part has a hollow cylindrical shape, said cylindrical shape having one end connected to said plug part, said cylindrical shape being open at the other end.

* * * * *